US005619969A

United States Patent [19]

Liu et al.

[11] Patent Number: 5,619,969

[45] Date of Patent: Apr. 15, 1997

[54] FUEL INJECTION RATE SHAPING CONTROL SYSTEM

[75] Inventors: Chung Y. Liu; Benjamin M. Yen; Lester L. Peters; Julius P. Perr; Russ P. Durrett, all of Columbus; Donald N. Case, Deputy; Dennis Ashwill, Columbus; Chris Sorg, Columbus; John Lane, Columbus; Mark Cavanagh, Columbus, all of Ind.

[73] Assignee: Cummins Engine Company, Inc., Columbus, Ind.

[21] Appl. No.: 563,344

[22] Filed: Nov. 28, 1995

Related U.S. Application Data

[63] Continuation of Ser. No. 489,450, Jun. 12, 1995, abandoned.

[51] Int. Cl.[6] ..... F02M 7/00; F02M 37/04

[52] U.S. Cl. ..... 123/447; 123/496; 123/468

[58] Field of Search ..... 123/446–7, 496, 123/500–502, 299, 300, 467, 468

[56] References Cited

U.S. PATENT DOCUMENTS

| | | | |
|---|---|---|---|
| 3,669,360 | 6/1972 | Knight . | |
| 3,718,283 | 2/1973 | Fenne . | |
| 3,747,857 | 7/1973 | Fenne . | |
| 3,817,456 | 6/1974 | Schlappkohl . | |
| 3,961,612 | 6/1976 | Okamoto et al. | 123/496 |
| 4,250,857 | 2/1981 | Taplin | 123/496 |
| 4,258,883 | 3/1981 | Hofmann et al. . | |
| 4,526,151 | 7/1985 | Tateishi et al. | 123/468 |
| 4,711,209 | 12/1987 | Henkel . | |
| 4,718,384 | 1/1988 | Takahashi | 123/496 |
| 4,811,715 | 3/1989 | Djordjevic et al. . | |
| 4,838,232 | 6/1989 | Wich . | |
| 4,889,288 | 12/1989 | Gaskell . | |
| 4,993,926 | 2/1991 | Cavanagh . | |
| 5,020,500 | 6/1991 | Kelly . | |
| 5,029,568 | 7/1991 | Perr . | |
| 5,054,445 | 10/1991 | Henkel et al. . | |
| 5,056,488 | 10/1991 | Eckert | 123/496 |
| 5,297,523 | 3/1994 | Hafner et al. | 123/468 |
| 5,441,027 | 8/1995 | Buchanon et al. . | |
| 5,526,792 | 6/1996 | Guth et al. | 123/496 |

FOREIGN PATENT DOCUMENTS

| | | | |
|---|---|---|---|
| 439919 | 12/1935 | Germany | 123/496 |
| 9427041 | 11/1994 | WIPO . | |

*Primary Examiner*—Thomas N. Moulis

*Attorney, Agent, or Firm*—Sixbey, Friedman, Leedom & Ferguson; Tim L. Brackett, Jr.; Charles M. Leedom, Jr.

[57] ABSTRACT

A fuel injection rate shaping control system is provided which effectively controls the flow rate of fuel injected into the combustion chamber of an engine to improve combustion and reduce emissions by controlling the rate of pressure increase during injection. The injection rate shaping control system includes a rate shaping control device including a rate shaping transfer passage having a predetermined length and diameter specifically designed to create a desired injection pressure rate shape. In other embodiments of the present invention, two or more rate shaping transfer passages capable of producing distinct rate shapes are packaged in various fuel injection systems to selectively provide various rate shapes depending on operating conditions. Switching valves, i.e., solenoid operated three-way valves, may be used to direct the fuel or timing fluid flow to any one of the rate shaping transfer passages. Also, a dampening means in the form of a reverse flow restrictor valve is positioned in the rate shaping transfer passage to dampen reflected pressure waves thereby minimizing the adverse effects thereof.

20 Claims, 4 Drawing Sheets

FUEL INJECTION RATE SHAPING CONTROL SYSTEM

This application is a continuation, of application Ser. No. 08/489,450, filed Jun. 12, 1995, now abandoned.

TECHNICAL FIELD

This invention relates to a rate shaping control system for a fuel system which effectively controls the flow rate of fuel injected into the combustion chamber of an engine to improve combustion.

BACKGROUND OF THE INVENTION

Fuel injection into the cylinders of an internal combustion engine is most commonly achieved using either a unit injector system or a fuel distribution type system. In the unit injector system, fuel is pumped from a source by way of a low pressure rotary pump or gear pump to high pressure pumps, known as unit injectors, associated with corresponding engine cylinders for increasing the fuel pressure while providing a finely atomized fuel spray into the combustion chamber. The fuel distribution type system, on the other hand, supplies high pressure fuel to injectors which do not pump the fuel but only direct and atomize the fuel spray into the combustion chamber.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate.

One method of reducing the initial volume of fuel injected during each injection event is to reduce the pressure of the fuel delivered to the fuel injector nozzle assemblies during the initial stage of injection. As a result, various devices have been developed to control or shape the rate of fuel delivery during the initial phase of fuel injection so as to reduce the fuel pressure delivered to the nozzle assemblies. For example, U.S. Pat. Nos. 3,669,360, 3,718,283, 3,747,857, 4,811,715, 3,817,456, 4,258,883, 4,889,288, 5,020,500 and 5,029,568 disclose devices associated with each injector nozzle assembly for creating an initial period of restricted fuel flow and a subsequent period of substantially unrestricted fuel flow through the nozzle orifice into the combustion chamber. However, these rate control devices require modifications to each of the fuel injector assemblies in a multi-injector system thus adding costs and complexity to the injection system.

Other fuel systems include rate shaping devices positioned upstream of the injector for controlling the initial volume of injected fuel. For example, U.S. Pat. No. 4,993,926 to Cavanagh discloses a fuel pumping apparatus capable of rate shaping which may be fluidically connected to a plurality of injectors via a distributor member. The fuel pump includes a piston having a passage formed therein for connecting a chamber to an annular groove for spilling fuel during an initial portion of an injection event. The piston includes a land which blocks the spill of fuel after the initial injection stage to permit the entirety of the fuel to be injected into the engine cylinder. However, the rate shaping pump delivers injection fuel directly to each injector during a pump stroke of the piston and thus the injection pressure is dependent on engine speed. As a result, although systems of this type can achieve the necessary pressures and injection accuracy under some engine conditions when provided with appropriate design and controls, such systems can not be relied upon to provide the desired performance objectives, such as very high injection pressures, over the long term especially at low engine speeds.

U.S. Pat. No. 4,838,232 to Wich discloses a fuel delivery control system including an injection rate control device positioned upstream of a fuel injector for creating an initial injection followed by a main injection. The control system includes a supply line of a specific length extending between a positive displacement pump and an injector assembly to create a hydraulic delay between initial and main injection events. The length of the supply line is chosen to create to a predetermined desired hydraulic delay corresponding to an ignition delay of the engine. However, the critical length of the supply line or passage extends between a fuel pump and an injector having a fuel control valve. Therefore, like the fuel system disclosed in Cavanagh discussed hereinabove, such a system can not be relied upon to provide the desired performance over the long term and especially at low engine speeds. Moreover, the Wich delivery control system creates a fixed rate shape or delay corresponding to the length of the supply line and therefore does not permit the rate of fuel flow to be shaped or varied during operation of an engine.

U.S. Pat. Nos. 4,711,209 and 5,054,445 to Henkel and Henkel et al., respectively, both disclose fuel injection systems including parallel fuel supply lines for creating pre-injection and main injection events. The fuel supply lines are designed with relative lengths such that the difference in lengths create different pressure wave traveling times and thus the desired delay between the pre-injection and main injection events.

Commonly assigned U.S. patent application Ser. No. 08/362,449 filed Jan. 6, 1995, discloses various rate shaping devices for use with an accumulator pump type system which effectively shape the rate of fuel injection by controlling the length of the fuel transfer passage connecting the accumulator to an injection control valve. These devices have been found to effectively slow down the rate of fuel injection during the initial portion of an injection event while subsequently increasing the rate of injection to rapidly achieve a high injection pressure.

Although the systems discussed hereinabove create different stages of injection, further improvement is desirable.

SUMMARY OF THE INVENTION

It is an object of the present invention, therefore, to overcome the disadvantages of the prior art and to provide an improved fuel injection system which effectively controls the flow rate of fuel injected into the combustion chamber of an engine so as to minimize engine emissions.

Another object of the present invention is to provide a rate shaping fuel injection system which permits the injection rate shape to be selectively changed during the operation of the engine.

A still further object of the present invention is to provide a rate shaping device for an injection system which permits the rate of injection to be selectively controlled based on the operating conditions of the engine.

Another object of the present invention is to provide a rate shaping device for effectively controlling the injection rate of fuel in an intensification-type injection system using timing fluid to pressurize the injection fuel by controlling the pressure rate change of the timing fluid.

Yet another object of the present invention is to provide a rate shaping device capable of effectively controlling the rate of fuel injection while minimizing the adverse effects of reflected pressure waves in the fuel transfer circuit.

These and other objects are achieved by providing a fuel system for supplying fuel at a predetermined pressure through plural fuel injection lines to the corresponding cylinders of a multi-cylinder internal combustion engine wherein the system comprises a fuel supply including a fuel transfer circuit for supplying fuel to the engine, a pump for pressurizing the fuel above the predetermined pressure, an accumulator for accumulating and temporarily storing fuel at high pressure received from the pump, a fuel distributor for receiving fuel from the accumulator and enabling sequential periodic fluidic communication with the engine cylinders through corresponding fuel injection lines, and a solenoid operated injection control valve positioned between the accumulator and the distributor for controlling the fuel injected into each engine cylinder to define sequential injection events. The injection control valve is movable between an open position permitting flow from the accumulator to the distributor and a closed position blocking fuel flow from the accumulator to the distributor. The fuel system includes a rate shaping control assembly positioned within the transfer circuit between the accumulator and the distributor for producing a predetermined time varying change in the pressure of fuel occurring sequentially at each engine cylinder. The rate shaping control assembly includes a rate shaping transfer passage, positioned between the accumulator and the injection control valve, having a predetermined length and a predetermined cross sectional flow area sufficient to cause a predetermined time delay between the movement of the injection control valve to the open position and the attainment of a maximum pressure during an injection event. The predetermined cross sectional flow area of the rate shaping transfer passage is selected to cause the maximum pressure to reach a predetermined level during the injection event. The predetermined length and the predetermined cross sectional flow area of the rate shaping transfer passage is selected to provide a desired high pressure wave traveling time period for the high pressure wave to travel from the accumulator to the engine cylinder upon the opening of the injection control valve. As a result, the high pressure wave traveling time period results in a delay between the time the low pressure wave reaches the engine cylinder and the time at which the high pressure wave reaches the engine cylinder.

The fuel system may also include a pressure wave dampening device including a reverse flow restrictor valve positioned within the fuel transfer circuit between the accumulator and the injection control valve for allowing substantially unimpeded forward flow of fuel toward the injection control valve while substantially restricting reverse flow thereby dampening any pressure waves traveling from the injection control valve toward the accumulator.

The rate shaping control assembly of the present invention may include a plurality of rate shaping devices positioned in parallel relative to the flow of fuel from the accumulator. The rate shaping control assembly may also include a switching valve for selectively directing fuel flow from the accumulator through one of the plurality of rate shaping devices during an injection event. The fuel flow from the accumulator through the switching valve during an injection event occurs through only one of the rate shaping devices so that each rate shaping device functions independently of the other to provide effective rate shaping throughout an injection event. Each of the rate shaping devices is designed to create a respective predetermined time varying change in the pressure of fuel during an injection event which is different than the predetermined time varying change in pressure created by the remaining rate shaping device. Each of the rate shaping devices may include a rate shaping transfer passage having a predetermined length and a predetermined cross sectional flow area causing an initial low pressure period followed by a main high pressure period during each injection event. In this embodiment, a pressure wave dampening device including a reverse flow restrictor valve could be positioned within each of the rate shaping transfer passages. The switching valve may be a three-way solenoid operated valve. Also, the rate shaping transfer passages may include four rate shaping transfer passages while the switching valve may be three, 3-way solenoid operated valves for effectively controlling the flow through the transfer passages.

The rate shaping assembly of the present invention may also be applied to the timing fluid circuit of other fuel systems such as a fuel intensification system using high pressure timing fluid to pressurize the injection fuel. In this embodiment, the fuel metering system includes a supply of fluid including a timing fluid accumulator, a timing fluid transfer circuit connected to the accumulator and a fuel metering transfer circuit. One or more fuel injectors positioned adjacent respective combustion chambers are provided to receive fuel at low pressure and injection fuel at relatively high pressure. Each of the fuel injectors includes an injector body containing an injector cavity, an orifice formed at one end of the injector body and a plunger means mounted for reciprocal movement in the injector cavity. A variable volume timing chamber formed in the cavity adjacent a first end of the plunger and a variable volume metering chamber formed adjacent a second end of the plunger are also provided. A fuel metering system controls the flow of the fuel to the metering chamber while a timing fluid control valve positioned in the timing fluid transfer circuit between the accumulator and the injectors controls the flow of timing fluid to the timing chamber. The timing fluid control valve moves between open and closed positions permitting and blocking, respectively, timing fluid therethrough to the timing chamber. Timing fluid in the timing chamber acts on the plunger when the timing fluid control valve is in the open position to force the plunger toward the metering chamber to effect injection. The system also includes a rate shaping control means positioned between the accumulator and the timing fluid control valve for producing the predetermined time varying change in the pressure of fuel occurring sequentially at each engine cylinder. The first end of the plunger may have an effective cross sectional area greater than the effective cross sectional area of the second end to thereby intensify the pressure of the metered fuel. The rate shaping control assembly may include a plurality of rate shaping control devices positioned in parallel to the flow of fuel from the accumulator and also include a switching valve for selectively directing timing fluid from the accumulator through one of the rate shaping devices during an injection event.

DETAILED DESCRIPTION OF THE PREFERRED EMBODIMENT

This application is a continuation-in-pan of PCT application Ser. No. PCT/US94/05108 filed May 6, 1994 and entering the U.S. national stage as Ser. No. 08/362,449 filed Jan. 6, 1995, which is a continuation-in-pan of U.S. patent application Ser. No. 057,489, filed May 6, 1993, now abandoned.

Figure 1:
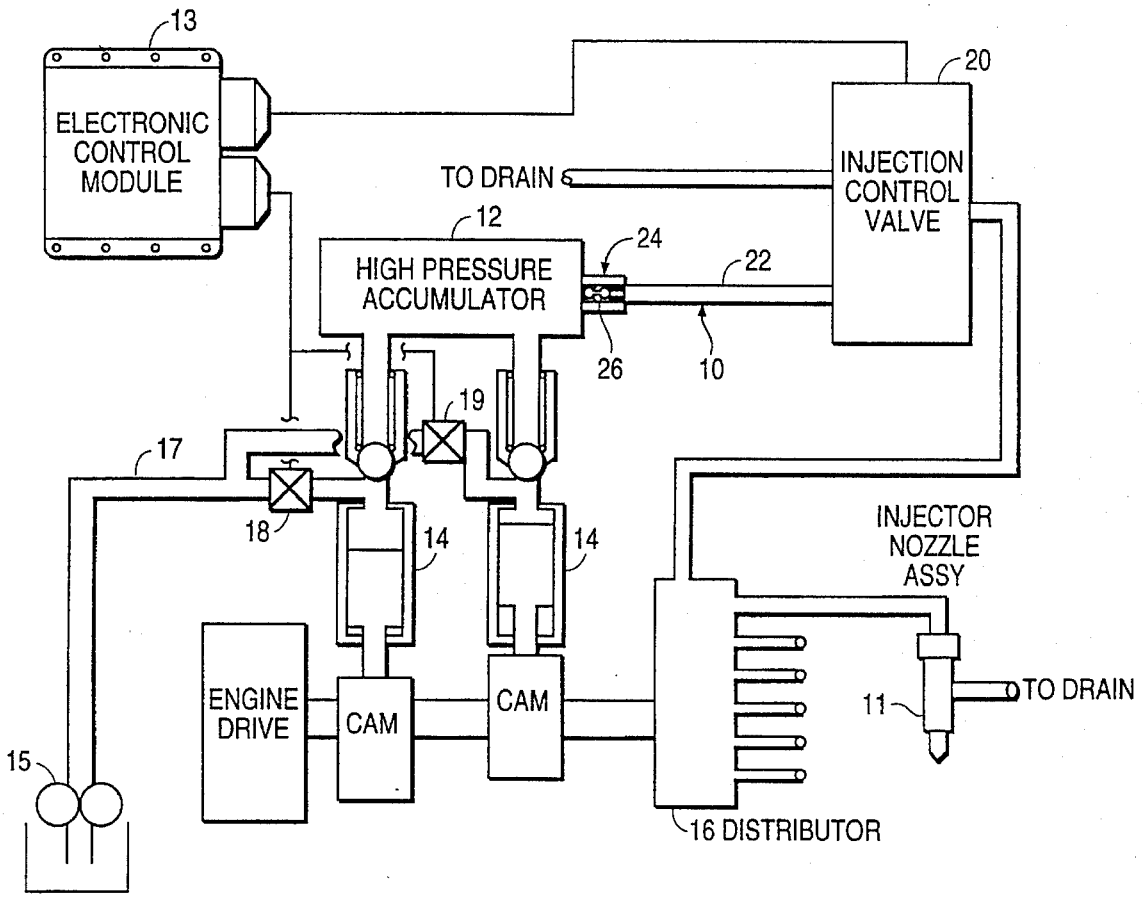
FIG. 1 is a schematic diagram of an accumulator pump fuel system including the rate shaping control device of the present invention.

As shown in FIG. 1, the rate shaping control device of the present invention, indicated generally at 10, is incorporated :into an accumulator-pump pump fuel system, such as the CAPS fuel system disclosed in co-pending U.S. patent application Ser. No. 08/362,449, filed Jan. 6, 1995, entitled "COMPACT HIGH PERFORMANCE FUEL SYSTEM WITH ACCUMULATOR" and assigned to the assignee of this invention which corresponds to International Publication No. WO 94/27041 published Nov. 24, 1994. The entire disclosure of that application is incorporated herein by reference. Specifically, the fuel system of FIG. 1 includes a high pressure accumulator 12 for receiving high pressure fuel for delivery to fuel injectors 11 of an associated engine, a high pressure pump 14 for receiving low pressure fuel from a low pressure supply pump 15 and delivering high pressure fuel to accumulator 12, and a fuel distributor 16 for providing periodic fluidic communication between accumulator 12 and each injector nozzle i 1 associated with a respective engine cylinder (not shown). The system also includes a fuel transfer circuit 17 for delivering fuel from supply pump 15 to each of the components of the system and ultimately to the injectors 11. The assembly also includes at least one pump control valve 18, 19 positioned along the fuel supply line to pump 14 for controlling the amount of fuel delivered to accumulator 12 so as to maintain a desired fuel pressure in accumulator 12. Also, one or more injection control valves 20 positioned along the fuel supply line from the accumulator 12 to distributor 16 is provided for controlling the timing and quantity of fuel injected into each engine cylinder in response to engine operating conditions. An electronic control module (ECU) 13 controls the operation of the pump control valves 18, 19 and the injection control valve 20 based on various engine operating conditions to accurately control the amount of fuel delivered by the distributor 16 to the injector nozzle 11 thereby effectively controlling fuel timing and metering.

The rate shaping control device 10 of the present invention is incorporated into the fuel system of FIG. 1 between high pressure accumulator 12 and injection control valve 20. By reducing the rate at which fuel pressure increases at the nozzle assembly during the initial phase of injection and, therefore, reducing the initial fuel quantity injected into the combustion chamber, various embodiments of the present invention are better able to achieve various objectives such as more efficient and complete fuel combustion with reduced emissions. The rate shaping devices discussed hereafter are designed to better enable various types of fuel systems to meet the ever increasing requirements for decreasing emissions.

Figure 2:
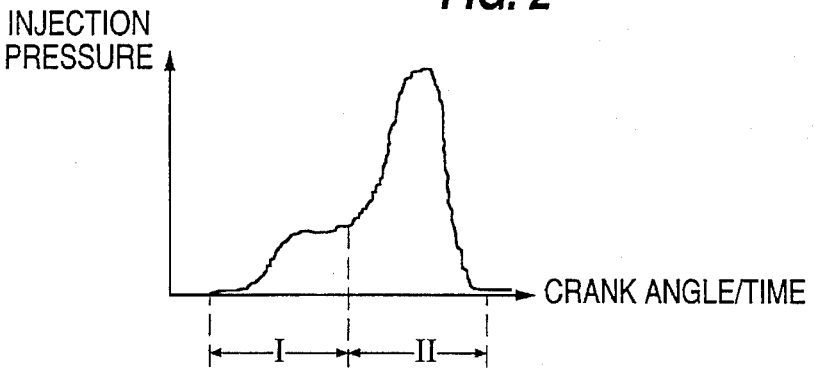
FIG. 2 is a graph showing the injection pressure rate as a function of time during an injection event using the rate shaping device of FIG. 1.

Referring to FIGS. 1 and 2, the rate shaping control device 10 of the present invention includes a high pressure rate shaping transfer passage 22 of fuel transfer circuit 17 connecting accumulator 12 to injection control valve 20. At the beginning of the injection event, when injection control valve 20 moves to an open position fluidically connecting accumulator 12 and rate shaping transfer passage 22 to fuel transfer circuit 17 downstream of injection control valve 20, an immediate drop in fuel pressure is experienced in rate shaping transfer passage 22 to create a low pressure region immediately upstream of injection control valve 20. Simultaneously, a first high pressure fuel pulse or wave travels from injection control valve 20 to the nozzle assembly 11 to create an initial low pressure injection as represented by stage I in FIG. 2. Subsequently, a second high pressure fuel pulse from accumulator 12, greater than the first high pressure pulse, quickly travels from the accumulator to the low pressure region and on to the nozzle assembly to create the main, high pressure injection as represented by stage II. Therefore, there is a time delay between the opening of injection control valve 20 and the arrival of the second high pressure pulse at injection control valve 20. The greater the distance the fuel pulse or wave must travel from accumulator 12 to injection control valve 20, the greater the amount of time it will take for the fuel pressure at the control valve and, therefore, in the fuel injection line adjacent the nozzle assembly, to increase to the pressure rate necessary to achieve optimum high fuel pressure. Therefore, the lengths of rate shaping transfer passage 22 appears to primarily control the duration of the initial low pressure stage of injection (stage I). It has also been found that the cross-sectional flow area, as determined by the inner diameter, of rate shaping transfer passage 22, primarily affects the maximum pressure achieved during the initial low pressure injection stage. Also, it has been found that the minimum diameter of transfer passage 22 is limited by the occurrence of unacceptably high pressure losses due to fluid turbulence caused by fluid interaction with the passage walls injection event.

Figure 3:
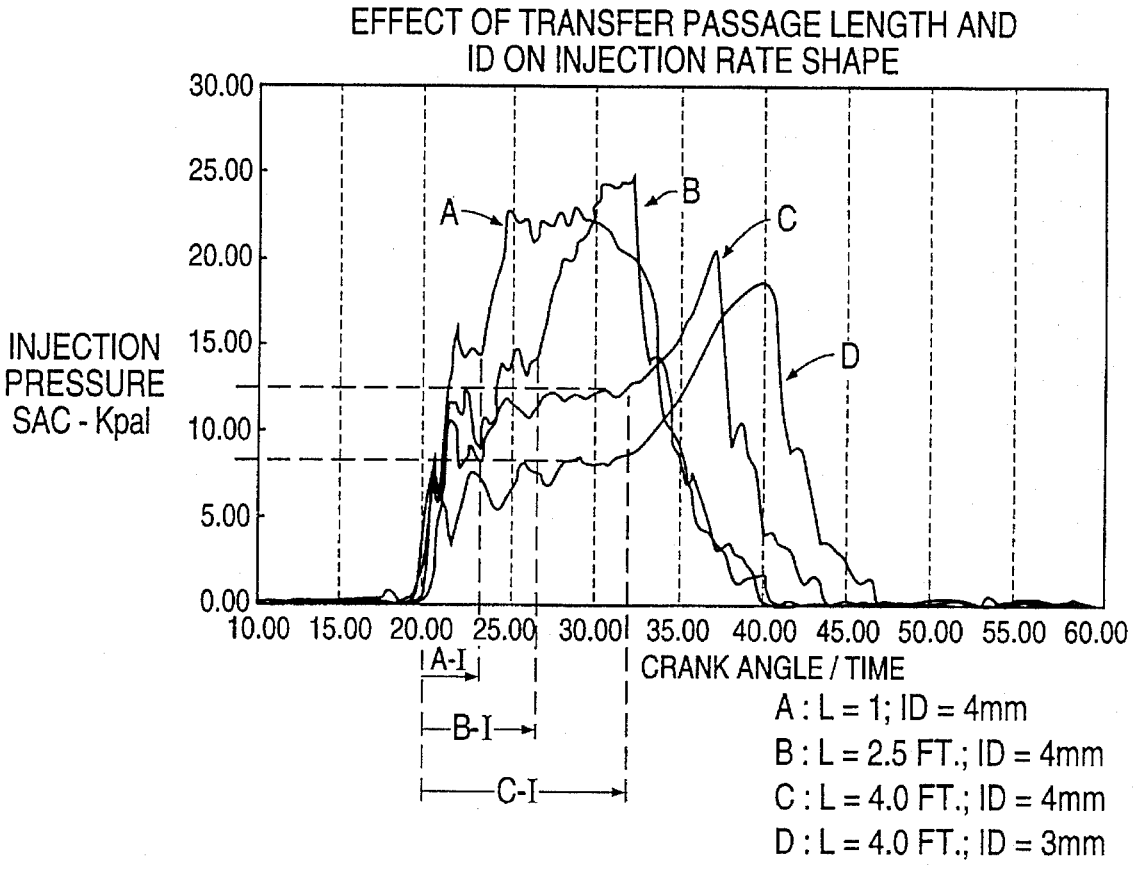
FIG. 3 is a graph showing the injection pressure as a function of time as shaped by rate shaping transfer passages having different length and cross sectional flow area combinations.

FIG. 3 illustrates the effect of the length and inner diameter of rate shaping transfer passage 22 on the duration of the initial injection event and the maximum injection pressure reached, respectively. Each of the rate shaping control passages A, B, C, D include different combinations of length (L) and inner diameter (ID). A comparison of the shape of the pressure rate trace of passages A, B, and C reveals that the initial injection event, represented by AI, BI, and CI, increases as the length of passages A, B, and C are increased from 1 foot to 2.5 feet, to 4 feet, respectively, while maintaining the inner diameter constant. FIG. 3 also illustrates the impact of the inner diameters on the level of pressure achieved during the injection event. A comparison of passages C and D, which have the same length but different inner diameters reveals that, although the duration of the initial injection event remains substantially constant, a smaller diameter rate shaping transfer passage significantly decreases the maximum pressure achieved during both the initial injection event and the subsequent main injection event. Therefore, a desired injection pressure rate shape necessary to achieve optimum combustion and decreased emissions for a specific engine in a particular application, can be achieved by designing the rate shaping control passage 22 with the appropriate length and inner diameter dimensions necessary to achieve the desired rate shape. Therefore, by increasing the distance between the accumulator 12 and injection control valve 20, i.e., by lengthening transfer passage 22, rate shaping control device 10 of the present invention slows down the rate of pressure increase at the nozzle assembly as represented by the pressure-time curve of FIG. 2.

Figure 4:
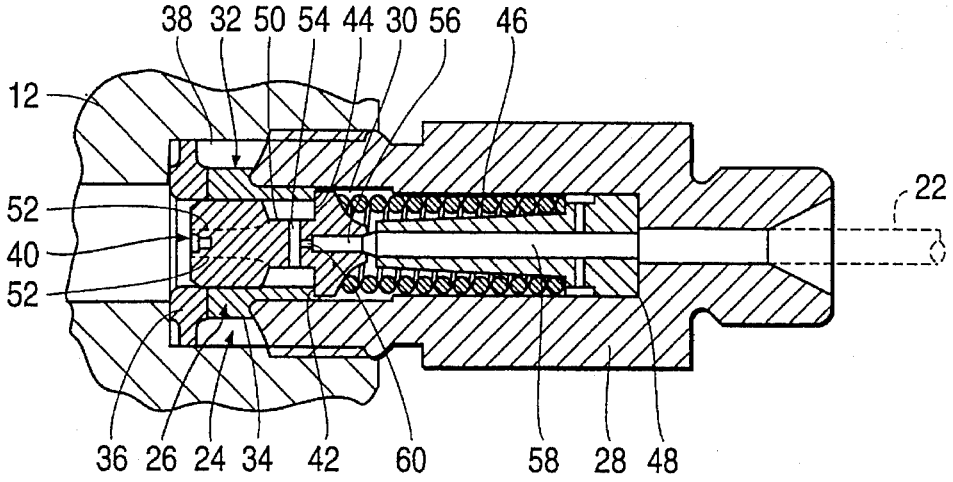
FIG. 4 is a partial cut-away cross sectional view of a pressure wave dampening device used in the fuel system of the present invention.

During operation, the opening and closing of injection control valve 20, which defines the injection events, causes undesirable pressure wave fluctuations in the rate shaping transfer passage 22. These reflecting pressure waves travel back and forth along rate shaping transfer passage 22 rebounding between injection control valve 20 and accumulator 12. These waves create adverse effects on the injection pressure rate shape at the nozzle assembly when the injection control valve 20 opens. The present invention minimizes the occurrence of these reflecting pressure waves by incorporating a pressure wave dampening device 24 in the form of a reverse flow restrictor, or snubber, valve 26. As shown in FIGS. 1 and 4, reverse flow restrictor valve 26 may be incorporated into a connector fitting 28 for connecting the upstream end of rate shaping transfer passage 22 to accumulator 12.

Referring to FIG. 4, connector fitting 28 includes a central bore 30 extending therethrough for receiving reverse flow restrictor valve 26. Reverse flow restrictor valve 26 includes a valve cylinder 32 positioned at the inlet end of fitting 28 and extending inwardly into central bore 30. Valve cylinder 32 includes an annular flange 34 positioned outside central bore 30 for abutment between a seal ring 36 and fitting 28. Accumulator 12 includes a recess 38 and threads formed annularly in the recess for engaging complementary threads formed on the upstream end of fitting 28. Relative rotation of fitting 28 and accumulator 12 places seal ring 36 and annular flange 34 of valve cylinder 32 in compressive abutting relationship between the upstream end of fitting 28 and the inner end of recess 38, thereby creating a fluid tight seal.

Reverse flow restrictor valve 26 further includes a movable valve element 40 slidably mounted in valve cylinder 32. Movable valve element 40 includes a valve surface 42 for sealing engagement with a complementary shaped valve seat 44 formed on the inner end of cylinder 32. A bias spring 46 positioned in central bore 30 biases valve surface 42 into sealing engagement with valve seat 44. A spring seat and guide 48 is positioned in central bore 30 opposite valve element 40 for supporting and guiding bias spring 46 toward movable valve element 40. Spring seat and guide 48 includes a stopping surface 41 formed at an upstream end for limiting the opening of valve element 40.

Movable valve element 40 includes an annular groove 50 formed immediately upstream of valve surface 42 and four axial grooves 52 equally spaced around the circumference of valve element 40 for fluidically communicating annular groove 50 with the inner end of recess 38 throughout the movement of valve element 40. Movable valve element 40 also includes a transverse passage 54 extending transversely through valve element 40 at annular groove 50, and an axial passage 56 communicating transverse passage 54 with central bore 30 downstream of valve seat 44. A central passage 58 formed in spring seat and guide 48 provides a fluid flow path through central bore 30 to rate shaping transfer passage 22. Cross passages 59, formed in guide 48, extend radially outward from central passage 58 to connect with central bore 30 downstream of stopping surface 41. During operation, when moving into the open position, movable valve element 40 may overtravel into abutment with stopping surface 41 thus at least partially blocking flow through central passage 58. Cross passages 59 provide a flow path around central passage 58 thereby maintaining an injection fuel flow path during an injection event.

Movable valve element 40 also includes a restriction orifice 60 connecting axial passage 56 to transverse passage 54. Between injection events, while injection control valve 20 is closed preventing flow through rate shaping tube 22, movable valve element 40 is biased to the left in FIG. 4 with valve surface 42 sealingly engaging valve seat 44. During this time, restriction orifice 60 functions to absorb any reflecting pressure waves travelling through rate shaping transfer passage 22 thus permitting a more accurate subsequent injection event. When injection control valve 20 opens at the beginning of the next injection event, the pressure differential across movable valve element 40 causes valve element 40 to move to the right in FIG. 4 creating a flow path between valve seat 44 and valve surface 42. Thus, high pressure fuel from accumulator 12 flows through axial grooves 52, annular groove 50, between valve seat 44 and valve surface 42 and on to rate shaping transfer passage 22 via central passage 58 and cross passages 59. Upon the closing of injection control valve 20, movable valve element 40 moves under the bias force of spring 46 into engagement with valve seat 44. Therefore, reverse flow restrictor valve 26 functions to dampen pressure waves between injection events while permitting full unimpeded fuel flow from the accumulator during injection events.

Figure 5:
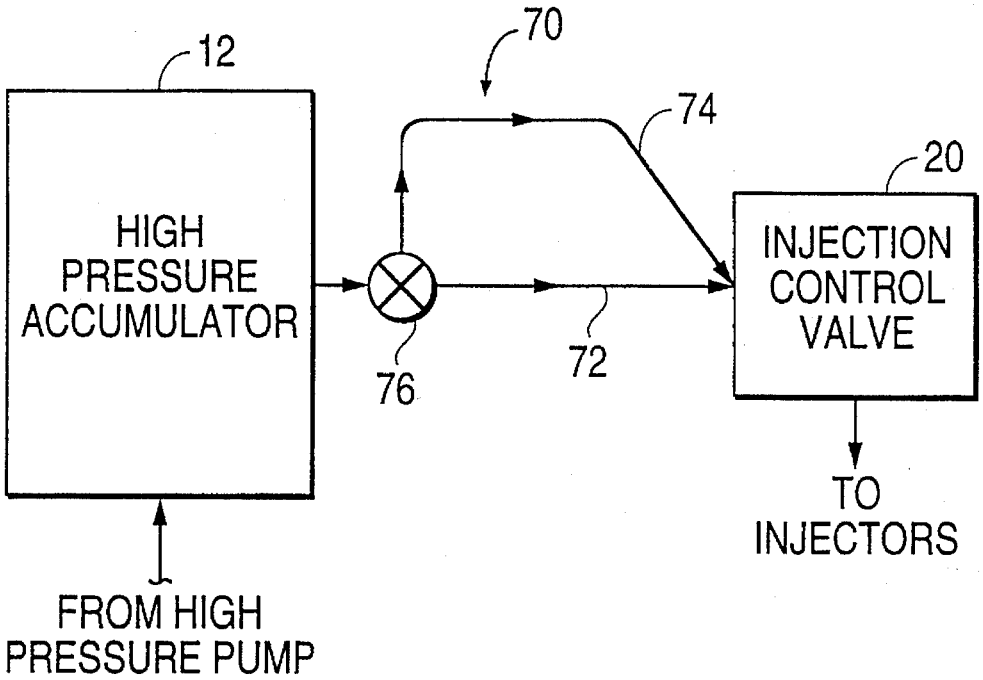
FIG. 5 is a schematic diagram of another embodiment of the rate shaping control device of the present invention.

Referring to FIG. 5, a second embodiment of the present invention is illustrated which includes a rate shaping control device indicated generally at 70. Rate shaping control device 70 includes a plurality of rate shaping transfer passages 72, 74 and a switching valve 76. Each of the rate shaping transfer passages 72, 74 have a predetermined length and inner diameter designed to create a predetermined rate shape desirable for a given set of operating conditions for an engine. For example, rate shaping transfer passage 72 could have the same length and inner diameter as passage B referred to in FIG. 3 while rate shaping transfer passage 74 may correspond to passage D of FIG. 3. Switching valve 76 functions to permit the injection rate shape of either transfer passage 72 or 74 to be selected depending on the particular operating conditions. Switching valve 76 may be any control valve capable of effectively moving between a position in which the accumulator is fluidically connected to the control valve via transfer passage 70 while transfer passage 72 is blocked, and a position blocking flow through rate shaping transfer passage 70 while permitting fluidic communication between accumulator 12 and injection control valve 20 via rate shaping transfer passage 72. Preferably, switching valve 76 is a fast acting solenoid operated three-way two-position valve. In this manner, switching valve 76 may be selectively actuated during the operation of the fuel system/engine to obtain an injection pressure rate shape corresponding to either of the rate shapes offered by rate shaping transfer passages 70 and 72.

Figure 6:
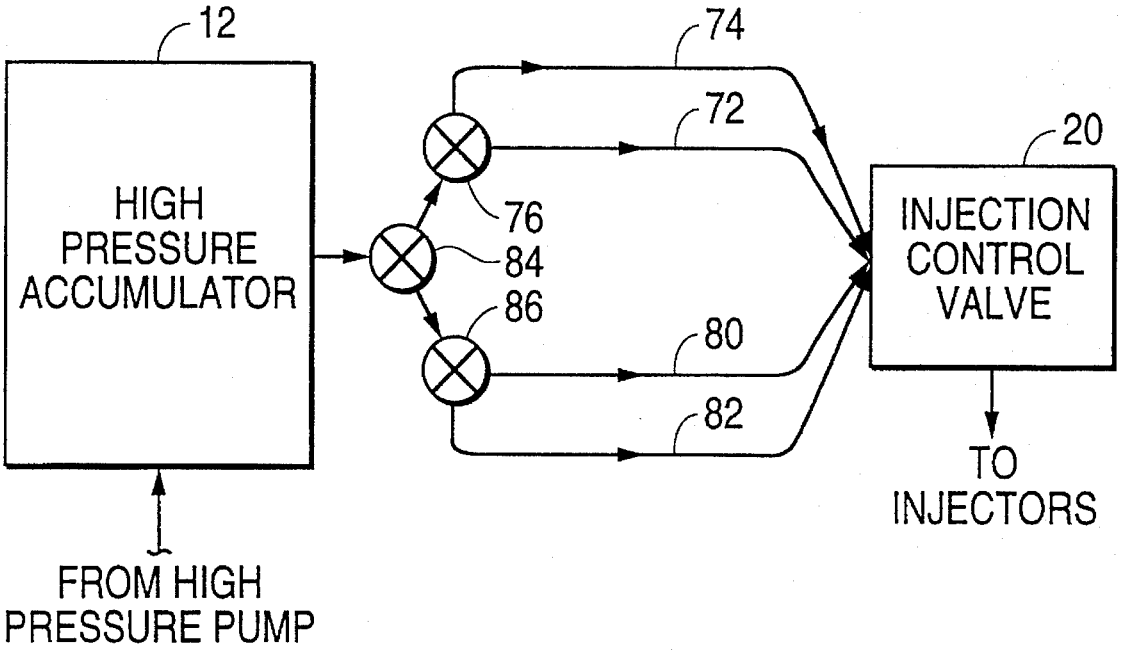
FIG. 6 is a schematic diagram of yet another embodiment of a rate shaping control device of the present invention.

FIG. 6 represents another embodiment of the rate shaping control device of the present invention which is very similar to the embodiment shown in FIG. 5 except that two additional rate shaping passages 80 and 82 have been incorporated along with two additional switching valves 84 and 86. Specifically, rate shaping transfer passages 72, 74, 80, and 82 are connected in parallel between high pressure accumulator 12 and injection control valve 20. Switching valve 76, as described with reference to FIG. 5, is operable to direct the flow from accumulator 12 to either of the rate shaping transfer passages 72 and 74 to create the respective rate shape. Likewise, switching valve 86 is operable to direct the flow from accumulator 12 through either of the rate shaping transfer passages 80, 82. A third switching valve 84 is positioned upstream of switching valves 76 and 86 for directing fuel flow from accumulator 12 to either switching valve 76 or switching valve 86 depending on the particular rate shaping transfer passage desired. Switching valves 84 and 86 are preferably solenoid operated three-way two-position control valves. As with the embodiment of FIG. 5, each of the rate shaping transfer passages 72, 74, 80, 82 have different dimensional characteristics (length and inner diameter) so as to cream a unique injection pressure rate shape.

During operation, switching valve 84 is positioned to direct flow toward either switching valve 76 or switching valve 86 while blocking flow to the other valve. The respective switching valve 76 or 86 is then actuated into a position permitting fuel flow through the desired rate shaping transfer passage. Switching valves 84, 86, and 76 are maintained in respective positions permitting fluidic communication between high pressure accumulator 12 and injection control valve 20 via only one of the rate shaping transfer passages until it is desired to modify the injection rate shape. At this point, for example, if fuel is flowing through rate shape passage 80 and it is desired to switch to the rate shape offered by rate shape transfer passage 82, switching valve 86 would be actuated between injection events into a position blocking flow through rate shape transfer passage 80 while permitting flow through passage 82. Moreover, as dictated by, for example, operating conditions of the engine, the rate shape of rate shaping transfer passage 74 may be obtained by actuating or deactuating switching valve 84 into a position blocking flow to switching valve 86 while permitting flow toward switching valve 76. Simultaneously, switching valve 76 would be operated to move into a position blocking flow through rate shaping transfer passage 72 while permitting flow into rate shaping transfer passage 74. In this manner, a variety of injection rate shapes can be obtained easily and quickly during the operation of the engine to thereby improve combustion and decrease emissions.

Figure 7:
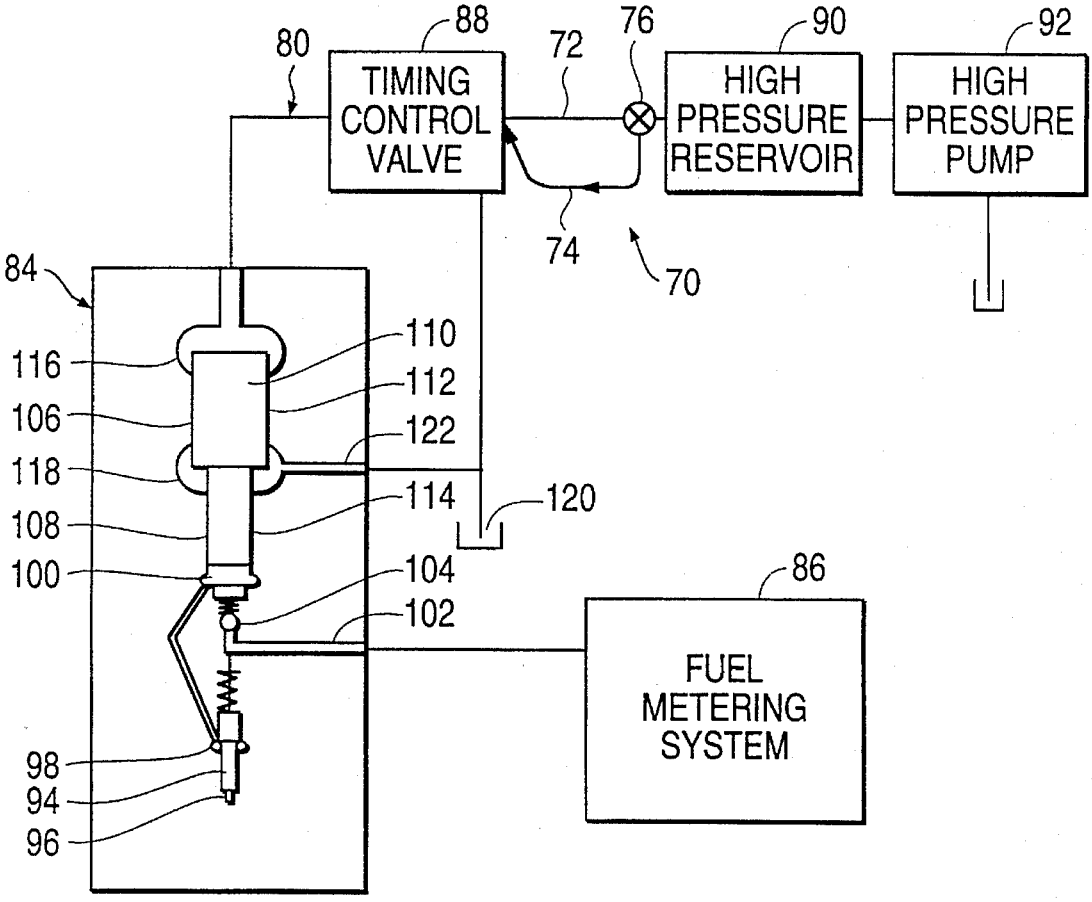
FIG. 7 is a schematic diagram of an intensification fuel system incorporating the rate shaping device of FIG. 5 into the timing fluid circuit.

FIG. 7 represents yet another embodiment of the present invention which includes the rate shaping control device 70 shown in FIG. 5 incorporated into the timing fluid transfer circuit 80 of a fuel system indicated generally at 82 which uses the pressure of the timing fluid to effect injection of metered fuel. Fuel injection system 82 includes a fuel injector 84 supplied with fuel for injection by a fuel metering system 86. Fuel metering system 86 is equivalent to the fuel metering system disclosed in commonly assigned U.S. Pat. No. 5,441,027. Which is hereby incorporated by reference. Therefore, fuel metering system 86 also supplies fuel to two other fuel injectors (not shown) associated with a first set of injectors including injector 84 and to a second set of three fuel injectors (not shown) assuming a six cylinder engine.

The timing fluid control portion of fuel injection system 82 of FIG. 7 includes a timing control valve 88, a high pressure reservoir or common rail 90 and a high pressure pump 92. Each injector of each set of injectors includes a respective timing control valve 88 receiving high pressure timing fluid from common rail 90 and common high pressure pump 92. Fuel injector 84 is of the closed nozzle type having a conventional tip valve element 94 spring biased against injector orifices 96 and positioned in a nozzle cavity 98 for receiving fuel from a metering chamber 100. Fuel is supplied from the metering system 86 to metering chamber 100 via a supply passage 102 and inlet check valve 104.

The upper timing portion of injector 84 includes a large axial bore 106 and a smaller axial bore 108 positioned inwardly of and axially aligned with bore 106. A plunger 110 includes an upper section 112 mounted for reciprocal movement in bore 106 and a lower section 114 mounted for reciprocal movement in bore 108. The outermost end of upper section 112 is positioned in a cavity 116 adapted to receive timing fluid from control valve 88. The innermost end of upper section 112 is positioned in a second cavity 118 which is connected to a timing fluid drain 120 by a drain passage 122.

Timing fluid control valve 88 is a three-way solenoid-operated valve which may be positioned to allow fuel to flow from reservoir 90 into cavity 116 to effect the inward movement of plunger 110 causing fuel injection at the appropriate time during each cycle of the engine. Control valve 88 may also be positioned to connect cavity 116 with drain 120 thus equalizing the pressure in cavities 116 and 118.

During operation, control valve 88 is positioned to allow high pressure timing fluid into cavity 116 thereby forcing plunger 110 inwardly, preventing fuel from the fuel metering system from entering the metering chamber 100 until just before the time period for injection by injector 84. At this time, timing control valve 88 is positioned to block the flow of timing fluid from common rail 90 while connecting cavity 116 to drain 120 thus starting the metering period. The fuel metering system 86 associated with the bank of injectors containing injector 84, may then be operated to allow fuel to pass through passage 102 into metering chamber 100. The pressure of the supply fuel entering metering chamber 100 forces plunger 110 outwardly until the associated fuel control valve closes, thus terminating the metering event. Timing control valve 88 may then be positioned to allow high pressure timing fluid from common rail 90 to flow to cavity 116. Prior to this operation of timing control valve 88, switching valve 76 will have been positioned so as to direct flow through either rate shaping transfer passage 72 or rate shaping transfer passage 74, depending on the injection pressure rate shape desired under the particular operating conditions. When timing control valve 88 opens to permit flow toward the injector from one of the rate shaping transfer passages 72, 74, a first high pressure pulse or wave travels from timing control valve 88 to cavity 116. The high pressure of the first high pressure wave of timing fluid acting on the end of plunger 110 positioned in cavity 116, forces plunger 110 inwardly at a first rate of movement. Lower section 114 of plunger 110 compresses fuel in metering chamber 100 and, consequently, nozzle cavity 98, until the fuel pressure in cavity 98 exceeds the spring bias pressure of tip valve 94 causing element 94 to move outwardly to allow fuel to pass through the injector orifices 96 at a reduced fuel flow rate corresponding to the reduced rate of injection pressure increase caused by rate shaping control device 70. Simultaneously, a high pressure wave begins to travel from common rail 90 through timing fluid transfer circuit 80 into cavity 116. After a predetermined time delay dictated by the length and inner diameter of the particular rate shaping transfer passage being used, the high pressure wave enters cavity 116 causing inward movement of plunger 110 and thus causing lower section 114 to compress the remainder of the fuel in metering chamber 100 resulting in the main high pressure injection event. When injection is complete, timing control valve 88 is returned to the position blocking the flow of timing fluid from common rail 90 and connecting cavity 116 to drain 120, thus positioning the injector for fuel metering during the next cycle of the engine. Therefore the injection rate shape of the present embodiment using the rate shaping control device 70 in the timing fluid transfer circuit results in initial reduced injection pressure rate followed by a high pressure injection rate as shown in FIG. 2.

Figure 8:
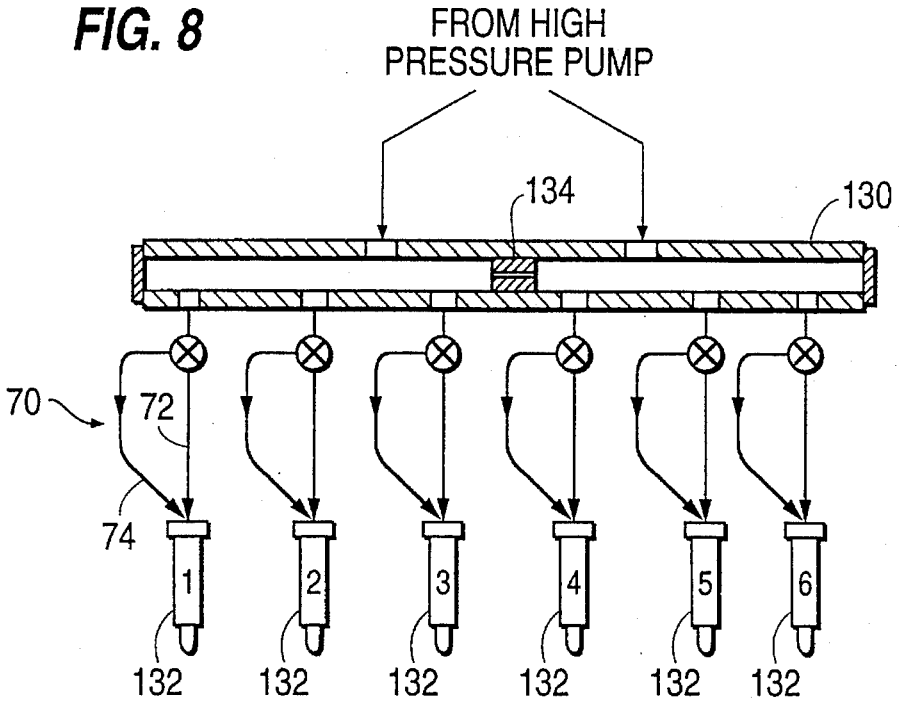
FIG. 8 is a schematic diagram of the rate shaping control device of FIG. 5 as incorporated in a common rail fuel system.

FIG. 8 illustrates yet another embodiment of the present invention incorporating the rate shaping control device 70 shown in FIG. 5 into a common rail type system including a common rail 130 providing injection fuel to each of the injectors 132. Each of the injectors 132 is connected to common rail 130 via a delivery passage which includes rate shaping control device 70 and thus rate shaping transfer passages 72 and 74. Each injector 132 includes a solenoid operated two-way valve for controlling the flow of fuel into the combustion chamber, thereby defining the injection events. The injectors may be of the type disclosed in commonly assigned U.S. Pat. No. 4,221,192 wherein a solenoid actuator is used to move an injector tip valve between open and closed positions. High pressure fuel from a high pressure pump is delivered to common rail 130 for subsequent delivery to each of the injectors via respective rate shaping control devices 70. The function and operation of rate shaping control device 70 is substantially the same as described hereinabove in relation to the embodiment of FIG. 5.

In addition, a dampening device in the form of a restriction or orifice 134 may be positioned in common rail 130 to minimize the adverse effects of pressure pulses, created at an injector and transmitted back to the common rail, on the injection quantity of subsequent injections by other injectors. The restriction 134 is formed in a partition positioned in the common rail separating the rail into two subrails. In the case of a six cylinder engine having one injector per cylinder, each subrail serves three injectors while being supplied by one high pressure pump. The injectors are matched to the respective subrails so that the sequential injection of fuel into the engine cylinders alternates between the subrails. Therefore, the injectors are preferably grouped with respect to the subrails so that the injection events alternate between the groups of injectors and therefore between the subrails thereby permitting restriction 34 to effectively minimize the pressure wave effects of one injection event on the next injection event.

It should be noted that the embodiments disclosed in FIGS. 7 and 8 could be modified to include the rate shaping control device disclosed in FIG. 6 hereinabove instead of the rate shaping control device 70 disclosed in FIG. 5. Moreover, the embodiments shown in FIGS. 5–8 could also include the reverse flow restrictor valve 26 of FIGS. 1 and 4. A reverse flow restrictor valve could be incorporated into each rate shaping transfer passage or alternatively, a single reverse flow restrictor valve could be used upstream of the respective switching valve controlling a set of rate shaping transfer passages to thereby minimize the adverse effects of reflecting pressure waves. Also, as a practical matter, the rate shaping transfer passages may be formed of tubing having the length and inner diameter dimensions necessary to create the desired rate shape. Alternatively, the rate shaping transfer passages may be completely or partially formed integrally in, for example, the accumulator block/housing.

INDUSTRIAL APPLICABILITY

It is understood that the present invention is applicable to all internal combustion engines utilizing a fuel injection system and to all closed nozzle injectors. This invention is particularly applicable to diesel engines which require accurate fuel injection rate control by a simple rate control device in order to minimize emissions. Such internal combustion engines including a fuel injector in accordance with the present invention can be widely used in all industrial fields and non-commercial applications, including trucks, passenger cars, industrial equipment, stationary power plant and others.

We claim:

1. A fuel system for supplying fuel at a predetermined pressure through plural fuel injection lines to the corresponding cylinders of a multi-cylinder internal combustion engine, comprising:

a fuel supply means for supplying fuel for delivery to the internal combustion engine, said fuel supply means including a fuel transfer circuit;

a pump means for pressurizing fuel above the predetermined pressure;

an accumulator means for accumulating and temporarily storing fuel at high pressure received from said pump means;

a fuel distributor means fluidically connected with said accumulator means through said fuel transfer circuit for enabling sequential periodic fluidic communication with the engine cylinders through the corresponding fuel injection lines;

a solenoid operated injection control valve positioned within said fuel transfer circuit between said accumulator means and said fuel distributor means for controlling the fuel injected into each engine cylinder during each of the sequential periods of communication enabled by said fuel distributor means to thereby define sequential injection events, said solenoid operated injection control valve movable between an open position permitting fuel flow from said accumulator means to said fuel distributor means and a closed position blocking fuel flow from said accumulator means to said fuel distributor means; and a rate shaping control means positioned within said fuel transfer circuit between said accumulator means and said fuel distributor means for producing a predetermined time varying change in the pressure of fuel occurring sequentially at each engine cylinder to effect injection, wherein fuel from said accumulator means is capable of reaching a maximum unrestricted flow rate corresponding to a maximum pressure in each of said fuel injection lines adjacent the respective engine cylinder during said injection event, said rate shaping control means including a rate shaping transfer passage positioned between said accumulator means and said injection control valve, said rate shaping transfer passage having a predetermined length and a predetermined cross sectional flow area sufficient to cause a predetermined time delay between the movement of said solenoid operated injection control valve to the open position and the attainment of said maximum pressure, wherein said predetermined cross sectional flow area of said rate shaping transfer passage is selected to cause said maximum pressure to reach a predetermined level.

2. The fuel system of claim 1, wherein movement of said solenoid operated injection control valve to said open position creates a low pressure wave and a high pressure wave in said fuel transfer circuit, the pressure wave traveling from said solenoid operated injection control valve to an engine cylinder, the high pressure wave traveling from said accumulator to an engine cylinder to define a high pressure wave traveling time period, wherein said predetermined length and said cross sectional flow area of said rate shaping transfer passage is selected to provide a desired high pressure wave traveling time period.

3. The fuel system of claim 2, further including a pressure wave dampening means for dampening pressure waves in said rate shaping transfer passage, said pressure wave dampening means including a reverse flow restrictor valve positioned within said fuel transfer circuit between said accumulator and said injection control valve for allowing substantially unimpeded forward flow of fuel toward each engine cylinder while substantially restricting reverse flow.

4. A fuel system for supplying fuel at a predetermined pressure to the corresponding cylinders of a multi-cylinder internal combustion engine to define respective injection events, comprising:

a fuel supply means for supplying fuel for delivery to the internal combustion engine, said fuel supply means including a fuel transfer circuit;

a pump means for pressurizing fuel above the predetermined pressure;

an accumulator means for accumulating and temporarily storing fuel at high pressure received from said pump means;

an injection control valve means positioned within said fuel transfer circuit between said accumulator means and the internal combustion engine for controlling the fuel injected into each engine cylinder during respective injection events;

a rate shaping control means positioned along said fuel transfer circuit between said accumulator means and said injection control valve means for producing a predetermined time varying change in the pressure of fuel occurring sequentially at each engine cylinder to effect injection, said rate shaping control means including a plurality of rate shaping devices positioned in parallel relative to the flow of fuel from said accumulator and a switching valve means for selectively directing fuel flow from said accumulator means through one of said plurality of rate shaping devices during an injection event, wherein fuel flow from said accumulator during an injection event occurs through only one of said rate shaping devices.

5. The fuel system of claim 4, wherein each of said plurality of rate shaping devices is designed to create a respective predetermined time varying change in the pressure of fuel during an entire injection event which is different than the predetermined time varying change in pressure created by each of the remaining rate shaping devices.

6. The fuel system of claim 5, wherein each of said plurality of rate shaping devices includes a rate shaping transfer passage having a predetermined length and a predetermined cross sectional flow area sufficient to cause said respective predetermined time varying change in the pressure of fuel to be injected during an injection event, said respective predetermined time varying change in fuel pressure during each injection event including an initial low pressure period followed by a main high pressure period.

7. The fuel system of claim 6, further including a fuel distributor means positioned along said fuel transfer circuit between said injection control valve means and the engine cylinders for enabling sequential periodic fluidic communication with the engine cylinders, wherein said injection control valve means includes a three-way solenoid operated control valve movable between an open position permitting fuel flow from said accumulator means to said fuel distributor means and a closed position blocking fuel flow from said accumulator means to said fuel distributor means.

8. The fuel system of claim 6, further including a pressure wave dampening means for dampening pressure waves in said plurality of rate shaping transfer passages, said pressure wave dampening means including a reverse flow restrictor valve positioned within said fuel transfer circuit between said accumulator and said injection control valve for allowing substantially unimpeded forward flow of fuel toward each engine cylinder while substantially restricting reverse flow.

9. The fuel system of claim 4, wherein said switching valve means includes a three-way solenoid operated valve.

10. The fuel system of claim 9, wherein said plurality of rate shaping transfer passages includes four rate shaping transfer passages and said switching valve means includes three three-way solenoid operated valves.

11. A fuel system for supplying fuel at a predetermined pressure to the corresponding cylinders of a multi-cylinder internal combustion engine to define respective injection events, comprising:

a fuel supply means for supplying fuel for delivery to the internal combustion engine, said fuel supply means including a fuel transfer circuit;

a pump means for pressurizing fuel above the predetermined pressure;

an accumulator means for accumulating and temporarily storing fuel at high pressure received from said pump means;

an injection control valve means positioned within said fuel transfer circuit between said accumulator means and the internal combustion engine for controlling the fuel injected into each engine cylinder during respective injection events;

a rate shaping control means positioned along said fuel transfer circuit between said accumulator means and said injection control valve means for producing a predetermined time varying change in the pressure of fuel occurring sequentially at each engine cylinder to effect injection, said rate shaping control means including a plurality of rate shaping transfer passages associated with each engine cylinder and positioned in parallel relative to fuel flow from said accumulator and a switching valve means for selectively directing fuel flow from said accumulator means through only one of said plurality of rate shaping transfer passages during an injection event.

12. The fuel system of claim 10, wherein each of said plurality of rate shaping transfer passages is designed to create a respective predetermined time varying change in the pressure of fuel during an entire injection event which is different than the predetermined time varying change in pressure capable of being created by each of the remaining rate shaping devices.

13. The fuel system of claim 12, wherein each of said plurality of rate shaping transfer passages includes a predetermined length and a predetermined cross sectional flow area sufficient to cause said respective predetermined time varying change in the pressure of fuel to be injected during an injection event, said respective predetermined time varying change in fuel pressure during each injection event including an initial low pressure period followed by a main high pressure period.

14. The fuel system of claim 6, further including a pressure wave dampening means positioned between said accumulator means and said injection control valve means for dampening pressure waves in said plurality of rate shaping transfer passages.

15. The fuel system of claim 14, wherein said pressure wave dampening means including a dampening valve including a movable valve element for allowing substantially unimpeded forward flow of fuel toward the engine cylinders while capable of substantially restricting reverse flow.

16. The fuel system of claim 4, wherein said switching valve means includes a three-way solenoid operated valve.

17. The fuel system of claim 9, wherein said plurality of rate shaping transfer passages includes four rate shaping transfer passages and said switching valve means includes three three-way solenoid operated valves.

18. A metering system for metering and timing of fuel injection in the combustion chambers of a multi-cylinder internal combustion engine comprising:

a fluid supply means for supplying fuel and timing fluid at a low supply pressure, said fluid supply means including a timing fluid accumulator, a timing fluid transfer circuit fluidically connected to said timing fluid accumulator and a fuel metering transfer circuit;

one or more fuel injectors positioned adjacent respective combustion chambers for receiving fuel at the low supply pressure and for injecting the fuel at relatively high pressure into respective combustion chambers of the engine, each of said one or more injectors including an injector body containing an injector cavity, an injector orifice formed at one end of the injector body and a plunger means mounted for reciprocal movement in said injector cavity, further including a variable volume timing chamber formed in said injector cavity adjacent a first end of said plunger means and a variable volume metering chamber formed adjacent an second end of said plunger means opposite said first end between said injector orifice and said plunger means;

a fuel metering means positioned in said fuel metering transfer circuit for controlling the flow of fuel to said metering chamber;

a timing fluid control valve positioned in said timing fluid transfer circuit between said timing fluid accumulator and said one or more injectors for controlling the flow of timing fluid to said timing chamber, said timing fluid control valve being movable between an open position wherein timing fluid may flow therethrough to said timing chamber and a closed position wherein fluid is blocked from flowing therethrough to said timing chamber, wherein timing fluid in said timing chamber acts on said plunger means when said timing fluid control valve is in said open position to force said plunger means toward said metering chamber;

a rate shaping control means positioned along said timing fluid transfer circuit between said timing fluid accumulator and said timing fluid control valve for producing a predetermined time varying change in the pressure of fuel occurring sequentially at each engine cylinder to effect injection.

19. The metering system of claim 18, wherein said first end of said plunger means has an effective cross-sectional area greater than the effective cross-sectional area of said second end.

20. The metering system of claim 18, wherein said rate shaping control means includes a plurality of rate shaping devices positioned in parallel relative to the flow of fuel from said accumulator and a switching valve means for selectively directing fuel flow from said accumulator means through one of said plurality of rate shaping devices during an injection event.

* * * * *